US006827563B2

(12) United States Patent
Hiwata et al.

(10) Patent No.: US 6,827,563 B2
(45) Date of Patent: Dec. 7, 2004

(54) SCROLL COMPRESSOR FOR CARBON DIOXIDE SUPPLIED WITH A LUBRICANT

(75) Inventors: Akira Hiwata, Shiga (JP); Yoshiyuki Futagami, Shiga (JP); Noboru Iida, Shiga (JP); Kiyoshi Sawai, Shiga (JP)

(73) Assignee: Matsushita Electric Industrial Co., Ltd., Kodoma (JP)

( * ) Notice: Subject to any disclaimer, the term of this patent is extended or adjusted under 35 U.S.C. 154(b) by 0 days.

(21) Appl. No.: 10/442,982

(22) Filed: May 22, 2003

(65) Prior Publication Data

US 2003/0219351 A1 Nov. 27, 2003

(30) Foreign Application Priority Data

May 24, 2002 (JP) ..... 2002-150326

(51) Int. Cl.[7] ..... F04C 18/04; F04C 29/02

(52) U.S. Cl. ..... 418/55.6; 418/55.5; 418/99; 418/100

(58) Field of Search ..... 418/55.6, 99, 100, 418/55.5

(56) References Cited

U.S. PATENT DOCUMENTS

| | | | | |
|---|---|---|---|---|
| 4,762,477 A | | 8/1988 | Hayano et al. | 418/55.6 |
| 5,217,359 A | | 6/1993 | Kawahara et al. | 418/55.6 |
| 5,931,650 A | * | 8/1999 | Yasu et al. | 418/55.6 |
| 6,129,532 A | | 10/2000 | Kato et al. | 418/55.6 |

FOREIGN PATENT DOCUMENTS

| | | |
|---|---|---|
| EP | 0 822 335 A2 | 2/1998 |
| EP | 0 911 526 A1 | 4/1999 |
| JP | 11-22665 | 1/1999 |
| JP | 2001-115958 | 4/2001 |

* cited by examiner

*Primary Examiner*—John J. Vrablik
(74) *Attorney, Agent, or Firm*—Armstrong, Kratz, Quintos, Hanson & Brooks, LLP

(57) ABSTRACT

According to a scroll compressor of the present invention, lubricant is supplied to a compression chamber in the proportions of 2% by weight or more and less than 20% by weight of the lubricant to the sucked refrigerant amount. With this, it is possible to provide an efficient scroll compressor even when carbon dioxide is used as the refrigerant.

7 Claims, 6 Drawing Sheets

SCROLL COMPRESSOR FOR CARBON DIOXIDE SUPPLIED WITH A LUBRICANT

TECHNICAL FIELD

The present invention relates to a scroll compressor in which a spiral lap of a fixed scroll part and a spiral lap of a turning scroll part are meshed with each other to form a compression chamber, a rotation-restraining mechanism restrains the turning scroll part from rotating to turn the turning scroll part along a circular orbit, a compression chamber formed between the spiral lap of the fixed scroll part and the spiral lap of the turning scroll part moves while changing a volume of the compression chamber, thereby compressing sucked refrigerant and discharging the refrigerant.

BACKGROUND TECHNIQUE

In domestic or service freezing air conditioning field, reciprocating type compressors, rotary type compressors and scroll type compressors are used as freezing air conditioning hermetical type compressors. Such reciprocating type compressors, rotary type compressors and scroll type compressors are developed while making full use of their characteristics of costs and performance.

If compressors are aimed at enhancing the degree of soundproofing and maintenance free, a hermetical type compressor in which a compressing mechanism and a motor mechanism are accommodated is used. The mainstreams of the hermetical type compressor are the scroll type compressors and rotary type compressors.

An example of a conventional scroll compressor will be shown. FIG. 8 is a sectional view of the scroll compressor.

In the scroll compressor, a fixed scroll part 2 and a turning scroll part 4 form a compression chamber 5. In the fixed scroll part 2, a spiral lap 2*a* rises from a mirror plate 2*b*. In the turning scroll part 4, a spiral lap 4*a* rises from a mirror plate 4*b*. The compression chamber 5 is formed between the mirror plate 2*b* and the mirror plate 4*b* by meshing the spiral lap 2*a* and the spiral lap 4*a* with each other. A rotation-restraining mechanism restrains the turning scroll part 4 from rotating, and the turning scroll part 4 turns along a circular orbit. The compression chamber 5 moves while changing its volume by the turning motion of the turning scroll part 4. In the compression chamber 5, sucked refrigerant is compressed, and the compressed refrigerant is discharged out. A predetermined back pressure is applied to an outer peripheral portion of the turning scroll part 4 and a back surface of the spiral lap so that the turning scroll part 4 is not separated from the fixed scroll part 2 and is not overthrown.

Refrigerant gas sucked by the intake pipe 1 passes through an intake chamber 3 of the fixed scroll part 2 and is trapped in a compression chamber 5 formed by meshing the fixed scroll part 2 and the turning scroll part 4 with each other, and the refrigerant gas is compressed while reducing a volume of the compression chamber 5 toward a center of the fixed scroll part 2, and the refrigerant gas is discharged from a discharge port 6. A back pressure chamber 8 is formed by being surrounded by the fixed scroll part 2 and a bearing 7. It is necessary that the back pressure chamber 8 always has a back pressure of such a degree that the turning scroll part 4 is not separated from the fixed scroll part 2, but if the back pressure is excessively great, the turning scroll part 4 is strongly pushed against the fixed scroll part 2, a scroll sliding portion is abnormally worn and the input is increased. Thereupon, there is provided a back pressure adjusting mechanism 9 for always keeping the back pressure constant. The back pressure adjusting mechanism 9 comprises a passage 10 having a valve 11. The passage 10 passes through the fixed scroll part 2 from the back pressure chamber 8 and is in communication with the intake chamber 3. If a pressure in the back pressure chamber 8 becomes higher than a set pressure, the valve 11 is opened, oil in the back pressure chamber 8 is supplied to the intake chamber 3 so that a pressure in the back pressure chamber 8 is maintained at a constant intermediate pressure. The intermediate pressure is applied to the back surface of the turning scroll part 4 so that the turning scroll part 4 is not overthrown during the operation. The oil supplied the intake chamber 3 moves to the compression chamber 5 together with the turning motion of the turning scroll part 4 to prevent the refrigerant from leaking from between the compressed spaces.

When carbon dioxide is used as the refrigerant and the compressor is operated under a pressure equal to or higher than a critical pressure, a pressure different between discharging pressure and suction pressure of the compressor is higher, by about 7 to 10 times, than a pressure different of the conventional refrigeration cycle in which chlorofluorocarbons are used as the refrigerant. For this reason, there is a problem that in the compression chamber 5 formed between the fixed scroll part 2 and the turning scroll part 4, the leakage from tip clearance of the laps 2*a* and 4*a* is increased and the performance is deteriorated.

According to a scroll compressor described in Japanese Patent Application Laid-open No. 2001-207979 for example, in order to reduce the leakage from between a companion's mirror plate and a tip clearance of the lap, a tip seal groove is formed in the tip clearance of the scroll lap, and a tip seal is mounted in the groove. However, this scroll compressor has problems that the sliding loss caused by contact of the tip seal is increased, the number of parts is increased, the number of processing steps is increased and thus, the productivity is deteriorated.

The present invention has been accomplished in view of the conventional problems, and it is an object of the invention to provide an efficient and reliable scroll compressor having a simple and inexpensive structure when carbon dioxide is used as refrigerant.

DISCLOSURE OF THE INVENTION

A first aspect of the present invention provides a scroll compressor in which a spiral lap of a fixed scroll part and a spiral lap of a turning scroll part are meshed with each other to form a compression chamber, a rotation-restraining mechanism restrains the turning scroll part from rotating to turn the turning scroll part along a circular orbit, a compression chamber formed between the spiral lap of the fixed scroll part and the spiral lap of the turning scroll part moves while changing a volume of the compression chamber, thereby compressing sucked refrigerant and discharging the refrigerant, wherein carbon dioxide is used as the refrigerant, an amount of lubricant to be supplied into the compression chamber is set to a ratio of 2% by weight or more and less than 20% by weight of an amount of the lubricant trapped in the compression chamber when a suction stroke of the refrigerant is completed.

According to this aspect, the lubricant supplied to the compression chamber functions as seal oil, and it is possible to reduce the leakage from tip clearance and sidewalls of the laps. Further, it is possible to minimize the increase of loss caused by sucking and heating. Since it is unnecessary to provide a tip seal, it is possible to reduce the costs without increasing the number of parts.

According to a second aspect of the invention, in the scroll compressor of the first aspect, a volume of the intake chamber of the fixed scroll part is 20% or more of a displacement volume of the compression chamber.

According to this aspect, since it is possible to sufficiently-mix the lubricant and the refrigerant before the refrigerant is compressed, it is possible to further enhance the sealing ability of the compression chamber and to reduce the leakage.

According to a third aspect of the invention, in the scroll compressor of the first aspect, the turning scroll part is provided therein with a throttle hole through which lubricant flows.

According to this aspect, it is possible to inexpensively realize the means for supplying lubricant to the compression chamber 5 in the proportions of 2% by weight or more and less than 20% by weight of the lubricant to the sucked refrigerant amount.

According to a fourth aspect of the invention, in the scroll compressor of the first aspect, the compressor further comprises a throttle hole through which lubricant flows intermittently by driving the turning scroll part.

According to this aspect, lubricant can be supplied to the compression chamber 5 in the proportions of 2% by weight or more and less than 20% by weight of the lubricant to the sucked refrigerant amount, and the supply amount can be adjusted with respect to the variation in refrigerant circulation amount. Therefore, it is possible to provide a more efficient scroll compressor.

According to a fifth aspect of the invention, in the scroll compressor of any one of the first to fourth aspects, oil having polyalkylene glycol as main ingredient is used as the lubricant.

According to this aspect, it is possible to enhance the machine efficiency with respect to the entire operation region and to reduce the leakage loss and thus, it is possible to provide a more efficient scroll compressor.

According to a sixth aspect of the invention, in the scroll compressor of any one of the first to fourth aspects, oil having polyol ester as main ingredient is used as the lubricant.

According to this aspect, under a condition in which the refrigerant circulation amount is large, the sealing ability of the compression chamber is further enhanced and it is possible to provide a more efficient scroll compressor.

A seventh aspect of the invention provides a scroll compressor in which a spiral lap of a fixed scroll part and a spiral lap of a turning scroll part are meshed with each other to form a compression chamber, a rotation-restraining mechanism restrains the turning scroll part from rotating to turn the turning scroll part along a circular orbit, a compression chamber formed between the spiral lap of the fixed scroll part and the spiral lap of the turning scroll part moves while changing a volume of the compression chamber, thereby compressing sucked refrigerant and discharging the refrigerant, wherein carbon dioxide is used as the refrigerant, oil having polyalkylene glycol as main ingredient is used as the lubricant, the turning scroll part is provided therein with a throttle hole through which the lubricant flows, lubricant is supplied to the compression chamber by the throttle hole in the proportions of 2% by weight or more and less than 20% by weight of the lubricant to the refrigerant trapped in the compression chamber when a suction stroke of the refrigerant is completed.

According to this aspect, the lubricant supplied to the compression chamber functions as seal oil, and it is possible to reduce the leakage from tip clearance of the laps and leakage from sidewalls. Further, it is possible to minimize the increase of loss caused by sucking and heating. Since it is unnecessary to provide a tip seal, it is possible to reduce the costs without increasing the number of parts, and it is possible to inexpensively realize the means for supplying lubricant to the compression chamber 5 in the proportions of 2% by weight or more and less than 20% by weight of the lubricant to the sucked refrigerant amount. Further, since oil having polyalkylene glycol as main ingredient is used, it is possible to enhance the machine efficiency with respect to the entire operation region and to reduce the leakage loss and thus, it is possible to provide a more efficient scroll compressor.

An eighth aspect of the invention provides a scroll compressor in which a spiral lap of a fixed scroll part and a spiral lap of a turning scroll part are meshed with each other to form a compression chamber, a rotation-restraining mechanism restrains the turning scroll part from rotating to turn the turning scroll part along a circular orbit, a compression chamber formed between the spiral lap of the fixed scroll part and the spiral lap of the turning scroll part moves while changing a volume of the compression chamber, thereby compressing sucked refrigerant and discharging the refrigerant, wherein carbon dioxide is used as the refrigerant, oil having polyol ester as main ingredient is used as the lubricant, the turning scroll part is provided therein with a throttle hole through which the lubricant flows, lubricant is supplied to the compression chamber by the throttle hole in the proportions of 2% by weight or more and less than 20% by weight of the lubricant to the refrigerant trapped in the compression chamber when a suction stroke of the refrigerant is completed.

According to this aspect, the lubricant supplied to the compression chamber functions as seal oil, and it is possible to reduce the leakage from tip clearance of the laps and leakage from sidewalls. Further, it is possible to minimize the increase of loss caused by sucking and heating. Since it is unnecessary to provide a tip seal, it is possible to reduce the costs without increasing the number of parts, and it is possible to inexpensively realize the means for supplying lubricant to the compression chamber 5 in the proportions of 2% by weight or more and less than 20% by weight of the lubricant to the sucked refrigerant amount. Further, since oil having polyol ester as main ingredient is used as the lubricant, under a condition in which the refrigerant circulation amount is large, the sealing ability of the compression chamber is further enhanced and it is possible to provide a more efficient scroll compressor.

BEST MODE FOR CARRYING OUT THE INVENTION

Figure 1:
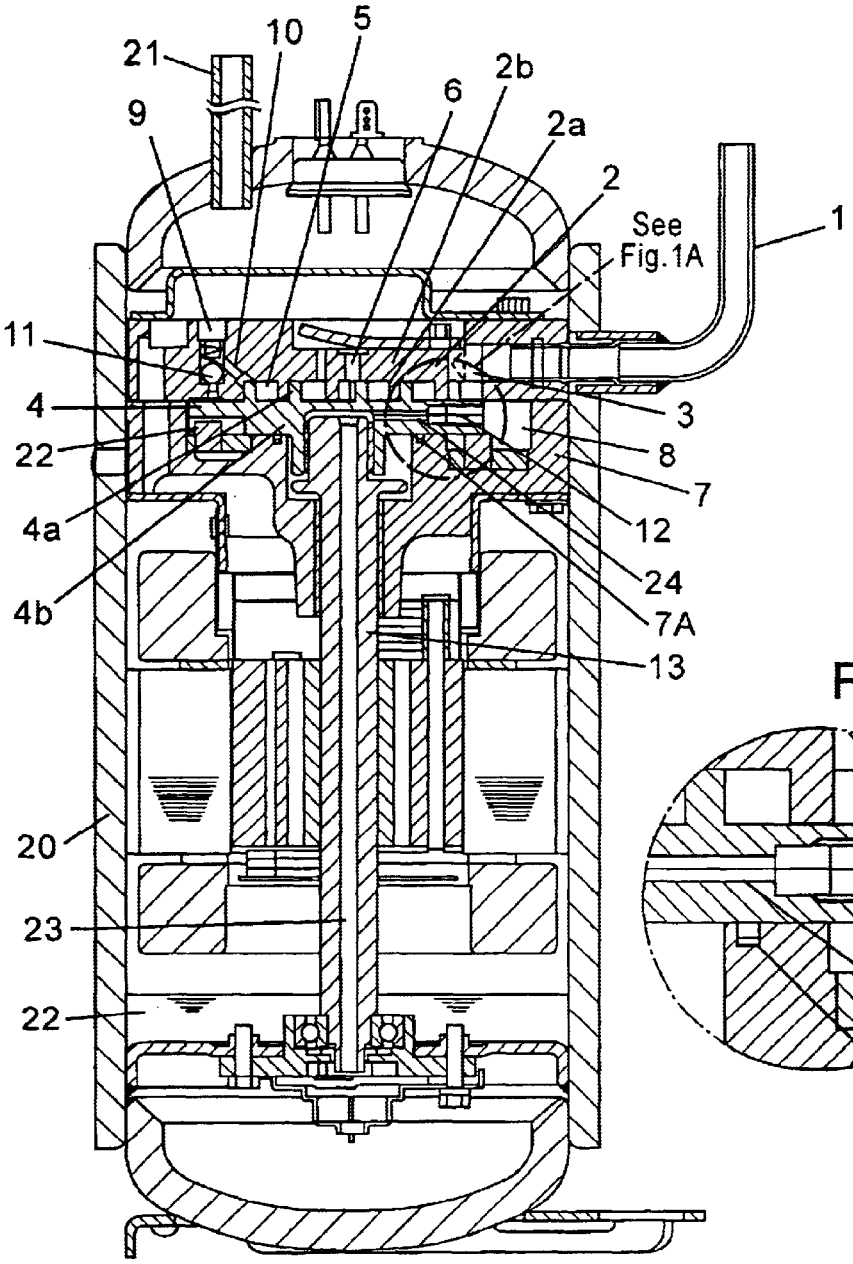
FIG. 1 is a sectional view of a fixed scroll part and a turning scroll part showing one embodiment of the present invention.
Figure 1A:
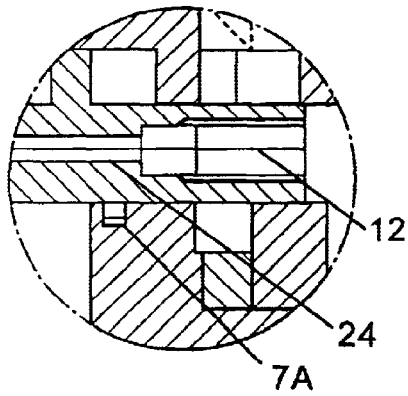
FIG. 1A is a detailed view of FIG. 1.

FIG. 1 is a sectional view of a scroll compressor according to a first embodiment.

The scroll compressor includes a compressing mechanism and a motor mechanism in a hermetical container 20. The compressing mechanism is disposed at an upper portion in the hermetical container 20, and the motor mechanism is disposed below the compressing mechanism. An intake pipe 1 and a discharge pipe 21 are provided on an upper portion of the hermetical container 20. An oil reservoir 22 in which lubricant is accumulated is provided at a lower portion in the hermetical container 20.

In the compressing mechanism, a compression chamber 5 comprising a plurality of compressed spaces is formed by the fixed scroll part 2 and the turning scroll part 4. The fixed scroll part 2 has a spiral lap 2*a* rising from a mirror plate 2*b*. The turning scroll part 4 has a spiral lap 4*a* rising from a mirror plate 4*b*. The compression chamber 5 is formed between the mirror plate 2*b* and the mirror plate 4*b* by meshing the spiral lap 2*a* and the spiral lap 4*a* with each other. A rotation-restraining mechanism 22 restrains the turning scroll part 4 from rotating, and the turning scroll part 4 turns along a circular orbit. The plurality of compressed spaces constituting the compression chamber 5 move while changing their volumes by the turning motion of the turning scroll part 4. A predetermined back pressure is applied to an outer peripheral portion of the turning scroll part 4 and a back surface of the spiral lap so that the turning scroll part 4 is not separated from the fixed scroll part 2 and is not overthrown.

Refrigerant gas sucked by the intake pipe 1 passes through an intake chamber 3 of the fixed scroll part 2 and is trapped in the compression chamber 5 formed by meshing the fixed scroll part 2 and the turning scroll part 4 with each other. The refrigerant gas is compressed while reducing a volume of the compression chamber 5 toward a center of the fixed scroll part 2, and the refrigerant gas is discharged from a discharge port 6. A back pressure chamber 8 is formed by being surrounded by the fixed scroll part 2 and a bearing 7. It is necessary that the back pressure chamber 8 always has a back pressure of such a degree that the turning scroll part 4 is not separated from the fixed scroll part 2. A ring-like seal member 7*a* is provided on that upper surface of the bearing 7 which is opposed to the turning scroll part 4. A back pressure adjusting mechanism 9 always constantly maintains the back pressure of the turning scroll part 4. The back pressure adjusting mechanism 9 has a passage 10 provided with a valve 11. The passage 10 passes through the fixed scroll part 2 from the back pressure chamber 8 and is in communication with the intake chamber 3. If a pressure in the back pressure chamber 8 becomes higher than a set pressure, the valve 11 is opened, oil in the back pressure chamber 8 is supplied to the intake chamber 3, and a pressure in the back pressure chamber 8 is maintained at a constant intermediate pressure. The intermediate pressure is applied to the back surface of the turning scroll part 4 so that the turning scroll part 4 is not overthrown during operation. The oil supplied the intake chamber 3 moves to the compression chamber 5 together with the turning motion of the turning scroll part 4 to prevent the refrigerant from leaking from between the plurality of compressed spaces which constitute the compression chamber 5.

Lubricant accumulated in an oil reservoir 22 passes through a passage 23 formed in a shaft 13 and is introduced into an upper end portion of the shaft 13. The lubricant introduced into the upper end portion of the shaft 13 lubricates slide surfaces between the shaft 13 and the turning scroll part 4, and slide surfaces between the shaft 13 and the bearing 7. A portion of the lubricant passes through a communication passage 24 provided in the turning scroll part 4, and is reduced in pressure in a throttle hole 12 mounted to the communication passage 24 and then, the portion of the lubricant is supplied to the back pressure chamber 8. If a pressure in the back pressure chamber 8 becomes higher than the set pressure, the valve 11 is opened, the lubricant in the back pressure chamber 8 is supplied to the intake chamber 3, and the lubricant accumulated in the back pressure chamber 8 functions as seal oil. In this embodiment, since the intake pipe 1, the intake chamber 3 and the back pressure adjusting mechanism 9 are superposed on each other, they are divided and illustrated on the left and right sides with respect to the shaft 13 for convenience's sake.

Table 1 shows discharge pressure, intake pressure, compression ratio and the number of revolution under four different operation conditions.

TABLE 1

| | High pressure [MPa] | Low pressure [MPa] | Compression ratio | The number of revolution [1/s] |
|---|---|---|---|---|
| Condition 1 | 8.0 | 3.8 | 2.1 | 17 |
| Condition 2 | 9.0 | 5.0 | 1.8 | 37 |
| Condition 3 | 10.0 | 4.0 | 2.5 | 62 |
| Condition 4 | 9.0 | 3.0 | 3.0 | 62 |

Figure 2:
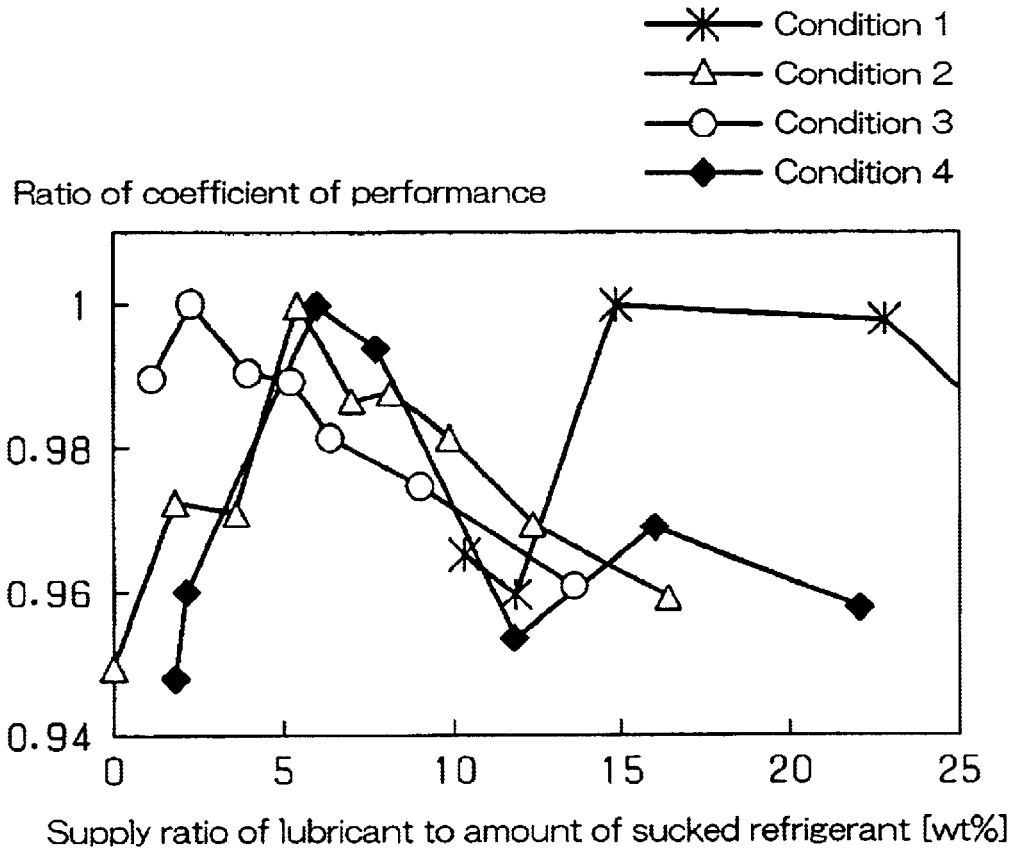
FIG. 2 is a graph showing a relation between performance and a supply ratio of lubricant to sucked refrigerant.

FIG. 2 shows a supply rate of lubricant and ratio of coefficient of performance with respect to the sucked refrigerant amount under the four different operation conditions shown in Table 1. The sucked refrigerant amount means an amount of refrigerant which is trapped when the scroll compressor completes the suction stroke. The ratio of coefficient of performance is a value obtained by dividing a coefficient of performance under the various conditions by a maximum value of the coefficient of performance. As can be found from FIG. 2, if lubricant is supplied to the compression chamber 5 in the proportions of 2% by weight or more and less than 20% by weight of the lubricant to the sucked refrigerant amount, the coefficient of performance becomes maximum. When carbon dioxide is used as the refrigerant, if the supply amount of lubricant is small, the sealing performance is deteriorated, the leakage loss of the compression chamber 5 is increased, and if the supply amount of lubricant is large, the refrigerant is excessively heated at the time of suction, the amount of refrigerant which can be trapped is reduced, and the efficiency of the compressor is deteriorated.

Figure 3:
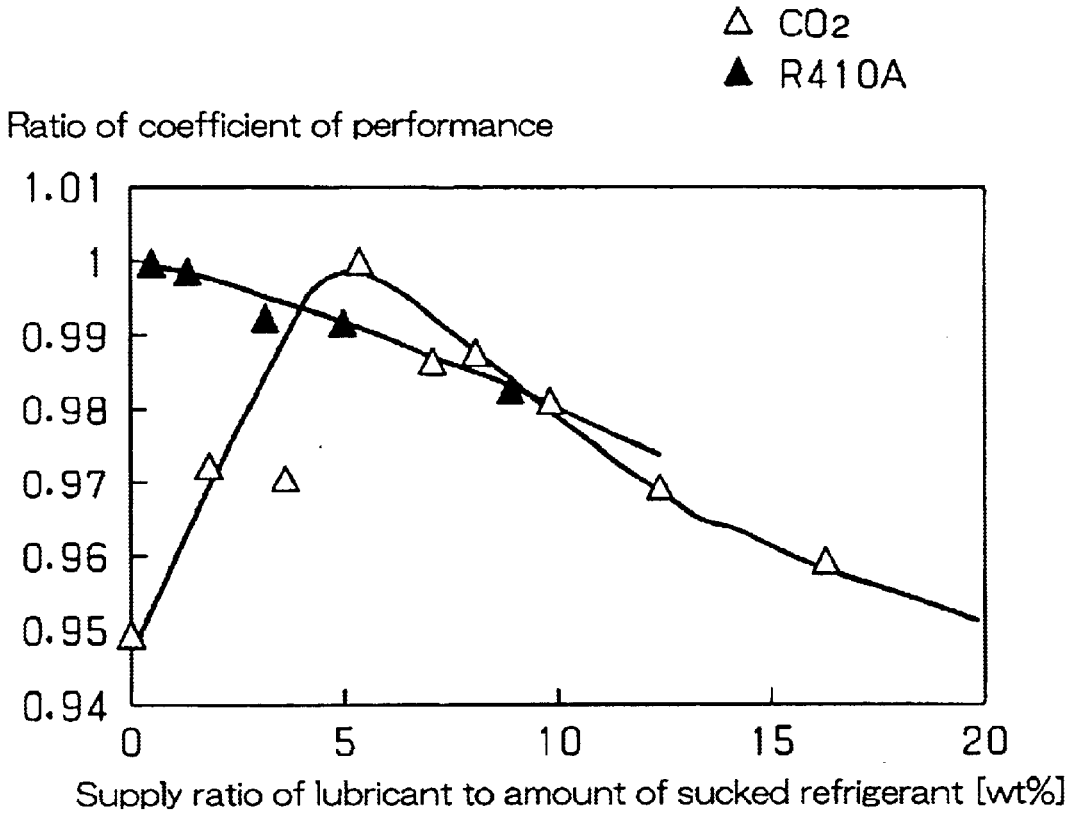
FIG. 3 is a graph showing the relation between the performance and the supply ratio of lubricant with respect to the sucked refrigerant while drawing comparisons between R 410 A and carbon dioxide.

In FIG. 3, a case in which R410A is used as lubricant and a case in which carbon dioxide is used as refrigerant are compared with each other. The supply ratio and the ratio of coefficient of performance of the lubricant to the sucked refrigerant amount when carbon dioxide was used were measured under the condition 2. The supply ratio and the ratio of coefficient of performance of the lubricant to the sucked refrigerant amount when R410A was used were measured by a scroll compressor which was designed such that the freezing ability and the frequency under the condition 2 when carbon dioxide was used became substantially equal to each other. It can be found from FIG. 3 that when R410A which is a conventional chlorofluorocarbon-based refrigerant is used, the ratio of coefficient of performance is enhanced as the supply ratio of the lubricant to the sucked refrigerant amount is smaller. Therefore, it is found that if the carbon dioxide is used as refrigerant, unlike the case in which the conventional chlorofluorocarbon-based refrigerant is used, it is necessary to supply the lubricant to the compression chamber in the appropriate proportions.

Figure 4:
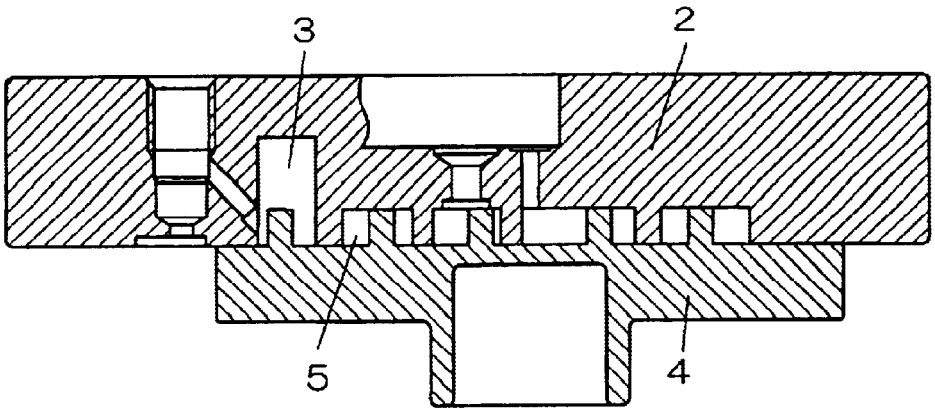
FIG. 4 is an enlarged view of the fixed scroll part, the turning scroll part and an intake chamber.

In this embodiment, by appropriately adjusting the throttle hole 12, it is possible to provide an efficient scroll compressor even if lubricant is supplied to the compression chamber 5 in the proportions of 2% by weight or more and less than 20% by weight of the lubricant to the sucked refrigerant amount, carbon dioxide is used as refrigerant and the scroll compressor is operated such that a high pressure side pressure becomes critical pressure or higher. If the throttle hole 12 is assembled into the communication passage 24 as a separate member, it is possible to inexpensively realize the means for supplying lubricant to the compression chamber 5 in the proportions of 2% by weight or more and less than 20% by weight of the lubricant to the sucked refrigerant amount. In the first embodiment shown in FIG. 1, since the intake pipe 1, the intake chamber 3 and the back pressure adjusting mechanism 9 are superposed on each other, they are divided and illustrated on the left and right sides with respect to the shaft 13 for convenience's sake. FIG. 4 shows enlarged cross sections of the fixed scroll part 2, the intake chamber 3, the turning scroll part 4 and the compression chamber 5. In the case of the scroll compressor using the conventional R410A as refrigerant, the volume of the intake chamber 3 is about 14% of displacement volume of the compression chamber 5. Here, the displacement volume of the compression chamber means the entire volume of a space which sucks refrigerant during one rotation of the turning scroll part. The volume of the intake chamber 3 is a volume of a space generated between the suction pipe and the compressed space. When carbon dioxide is used as refrigerant, however, since the refrigerant viscosity at the time of suction is increased by about 1.4 times as compared with a case in which the R410A is used as refrigerant, the lubricant and the refrigerant are not sufficiently mixed, and function of the compression chamber 5 as seal oil is deteriorated. Thereupon, the intake chamber 3 which is larger by a value corresponding to the refrigerant viscosity at the time of suction is formed, and when the volume of the intake chamber 3 of the fixed scroll part 2 is 20% or higher than the displacement volume of the compression chamber 5, the lubricant and the refrigerant can be mixed sufficiently before the refrigerant is compressed and thus, it is possible to enhance the sealing ability of the compression chamber 5 and to further enhance the effect which reduces the leakage.

Figure 5:
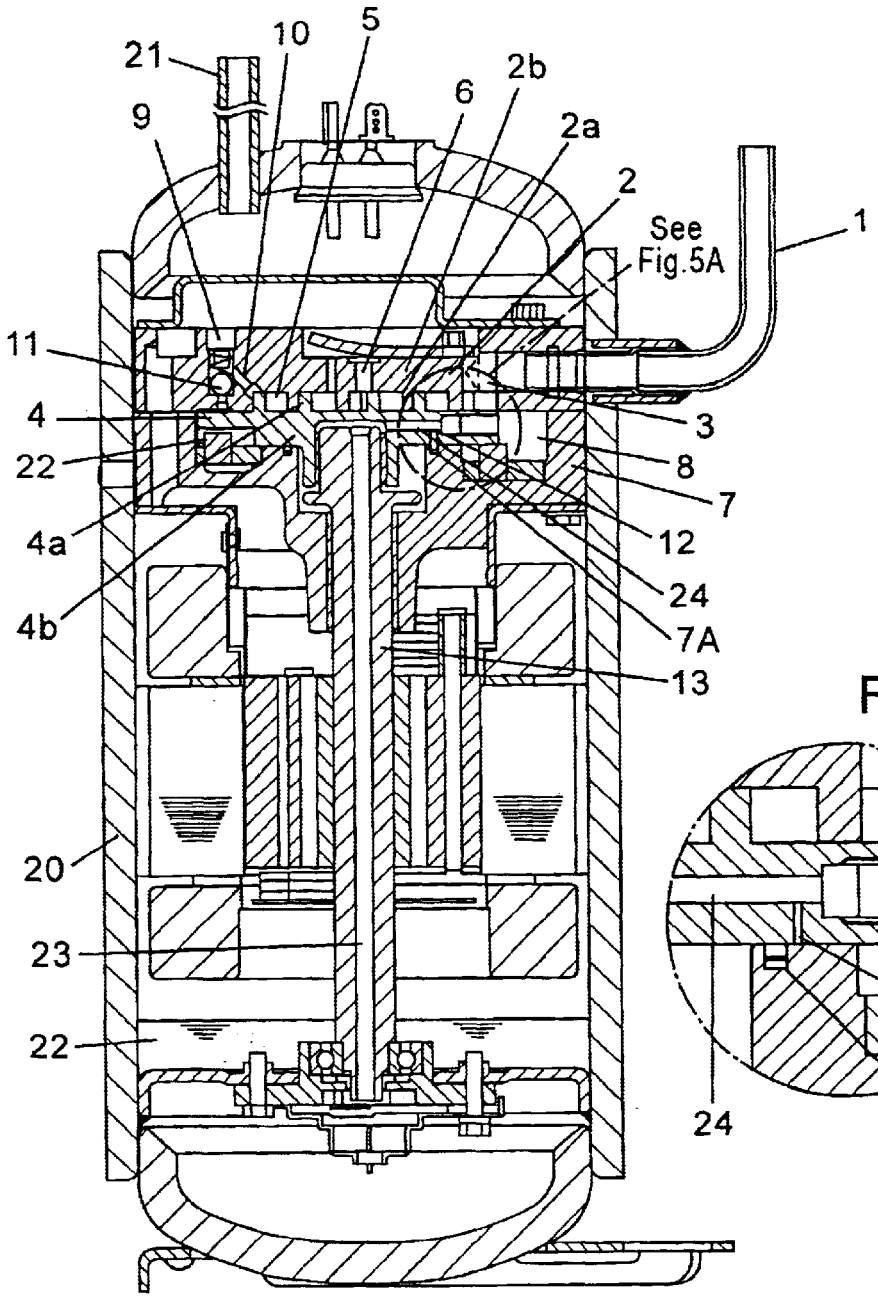
FIG. 5 is a sectional view of the fixed scroll part and the turning scroll part showing one embodiment of the invention.
Figure 5A:
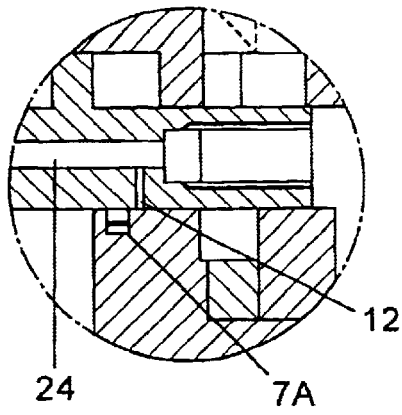
FIG. 5A is a detailed view of FIG. 5.

FIG. 5 shows a second embodiment. According to a scroll compressor of the second embodiment, the throttle hole in the embodiment shown in FIG. 1 is driven by the turning scroll part 4 to intermittently supply lubricant. That is, as shown in FIG. 5, an opening of the throttle hole 12 is provided in that lower surface of the turning scroll part 4 which is opposed to the bearing 7. If the turning scroll part 4 is driven, the opening of the throttle hole 12 straddles the seal member 7A of the bearing 7 and is positioned on the side of the inner periphery and on the side of the outer periphery of the seal member 7A. If the opening is located on the side of the outer periphery of the seal member 7A, lubricant is supplied to the back pressure chamber 8. If the opening is located on the side of the inner periphery of the seal member 7A, lubricant is not supplied to the back pressure chamber 8.

Figure 6:
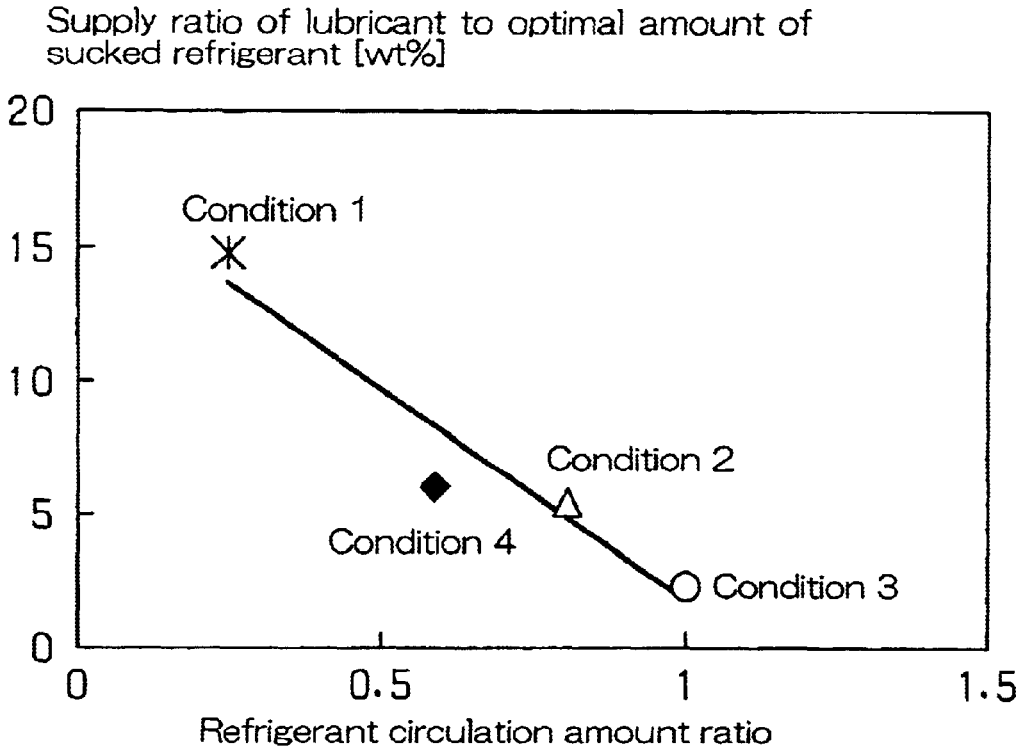
FIG. 6 is a graph showing a relation between an optimal supply ratio of lubricant with respect to the sucked refrigerant and a refrigerant circulation amount.

Concerning the four different conditions shown in Table 1, FIG. 6 shows optimal ratio of lubricant supply to the compression chamber 5 with respect to the refrigerant circulation amount. It can be found from FIG. 6 that although parameters concerning various leakages are set in different manners in the four different conditions, the optimal supply ratio of lubricant to the compression chamber 5 has strong correlation with respect to the refrigerant circulation amount. Since this scroll compressor includes the throttle hole 12 which intermittently supplies lubricant to the compression chamber 5, the amount of lubricant to be supplied to the compression chamber 5 can be expressed as follows:

$$Q = C \cdot \Delta P \cdot \frac{f}{v} \cdot \log\left(\cosh\left(v \cdot \frac{32}{d^2} \cdot \frac{To}{360} \cdot \frac{1}{f}\right)\right)$$

Here, Q represents a supply amount, C represents a constant, ΔP represents a pressure difference, f represents frequency, v represents kinetic viscosity, d represents a diameter of a throttle hole and To represents supply time per one rotation. As can be found from the above equation, it is possible to appropriately adjust the amount of lubricant to be supplied to the compression chamber 5, to supply the lubricant to the compression chamber 5 in the proportions of 2% by weight or more and less than 20% by weight of the lubricant to the sucked refrigerant amount, and to adjust the supply amount with respect to the variation in the refrigerant circulation amount. Therefore, it is possible to provide a more efficient scroll compressor.

Figure 7:
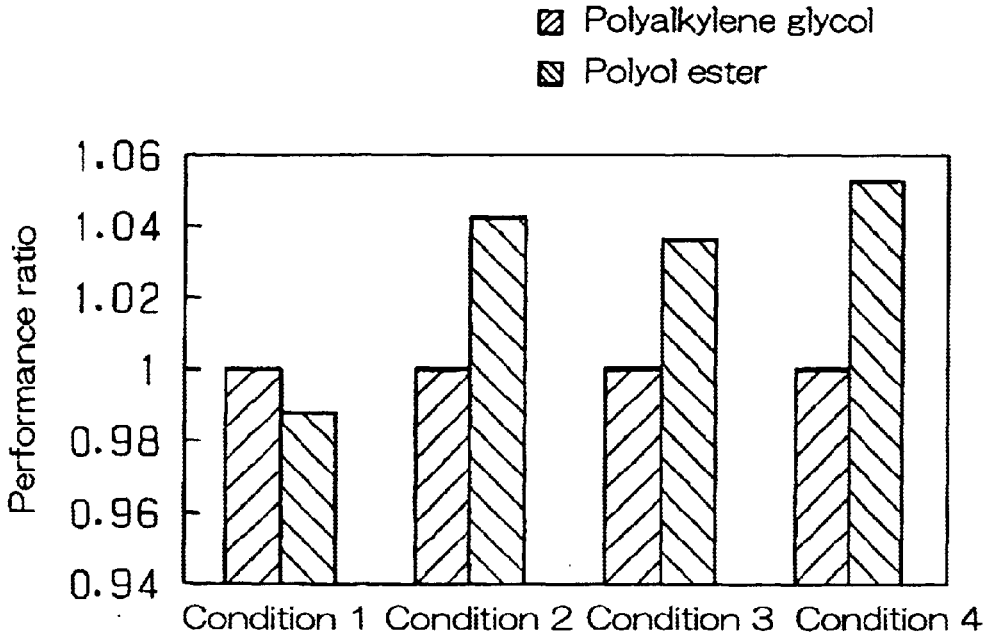
FIG. 7 is a graph showing a relation of performance caused by difference in oil.
Figure 8:
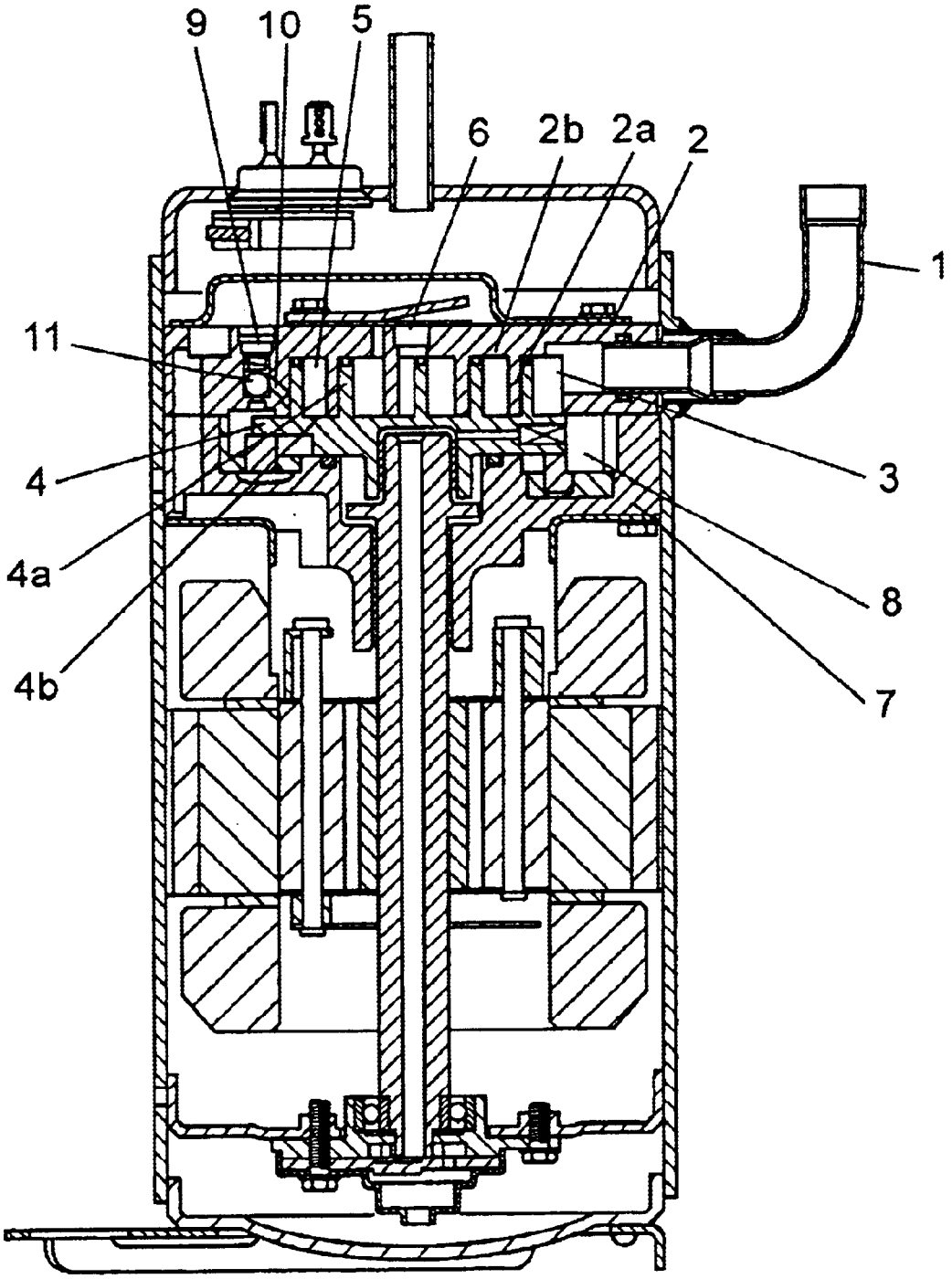
Fig. 8 BACKGROUND ART
FIG. 8 is a sectional view of a conventional scroll compressor.

FIG. 7 shows third and fourth embodiments. In FIG. 7, compressor performance when oil having polyalkylene glycol as main ingredient is used and when oil having polyol ester as main ingredient is used is compared. When oil having polyalkylene glycol as main ingredient is used, since compatibility with respect to carbon dioxide is low, if refrigerant and lubricant are not mixed sufficiently before the compression is started, the sealing ability is deteriorated. Generally, the polyalkylene glycol can excellently maintain the lubricity of the sliding portion. When lubricant is supplied to the compression chamber 5 in the proportions of 2% by weight or more and less than 20% by weight of the lubricant to the sucked refrigerant amount, and the volume of the intake chamber 3 of the fixed scroll part 2 is 20% or more of the displacement volume of the compression chamber 5, it is possible to enhance the machine efficiency with respect to the entire operation region and to reduce the leakage loss. Therefore, it is possible to provide a more efficient scroll compressor. On the other hand, when oil having polyol ester as main ingredient is used, since the compatibility with respect to carbon dioxide is high, lubricant is washed out together with refrigerant between gaps, and effect as seal oil is deteriorated. This phenomenon especially appears when the refrigerant circulation amount is small. However, when lubricant is supplied to the compression chamber 5 in the proportions of 2% by weight or more and less than 20% by weight of the lubricant to the sucked refrigerant amount, and the volume of the intake chamber 3 of the fixed scroll part 2 is 20% or more of the displacement volume of the compression chamber 5, it is possible to sufficiently mix the refrigerant and lubricant before compression is started under a driving condition in which the refrigerant circulation amount is large. Therefore, before lubricant is washed out together with refrigerant between gaps and effect as seal oil is deteriorated, lubricant is newly supplied in between the gaps and the sealing ability can be enhanced remarkably. Especially under a condition in which the refrigerant circulation amount is large, it is possible to provide a more efficient scroll compressor.

Industrial Applicability

According to the present invention, the lubricant supplied to the compression chamber functions as seal oil, and it is possible to reduce the leakage from tip clearance of the laps and leakage from sidewalls. Further, it is possible to minimize the increase of loss caused by sucking and heating.

Further, according to the invention, since a volume of the intake chamber of the fixed scroll part is 20% or more of a displacement volume of the compression chamber, it is possible to sufficiently mix the lubricant and the refrigerant before the refrigerant is compressed, and it is possible to further enhance the sealing ability of the compression chamber and to reduce the leakage.

Further, according to the invention, since the turning scroll part is provided therein with a throttle hole through which lubricant flows, it is possible to inexpensively realize the means for supplying lubricant to the compression chamber in the proportions of 2% by weight or more and less than 20% by weight of the lubricant to the sucked refrigerant amount.

Further, according to the invention, since the compression chamber further comprises a throttle hole through which lubricant flows intermittently by driving the turning scroll part, lubricant can be supplied to the compression chamber in the proportions of 2% by weight or more and less than 20% by weight of the lubricant to the sucked refrigerant amount, and the supply amount can be adjusted with respect to the variation in refrigerant circulation amount. Therefore, it is possible to provide a more efficient scroll compressor.

Further, according to the invention, since oil having polyalkylene glycol as main ingredient is used as the lubricant, it is possible to enhance the machine efficiency with respect to the entire operation region and to reduce the leakage loss and thus, it is possible to provide a more efficient scroll compressor.

Further, according to the invention, since oil having polyol ester as main ingredient is used as the lubricant, under a condition in which the refrigerant circulation amount is large, the sealing ability of the compression chamber is further enhanced and it is possible to provide a more efficient scroll compressor.

What is claimed is:

1. A scroll compressor comprising a spiral lap of a fixed scroll part and a spiral lap of a turning scroll part which are meshed with each other to form a compression chamber, a rotation-restraining mechanism which restrains said turning scroll part from rotating to turn the turning scroll part along a circular orbit, a compression chamber formed between the spiral lap of said fixed scroll part and the spiral lap of said turning scroll part which moves while changing a volume of said compression chamber, thereby compressing sucked refrigerant and discharging the refrigerant, wherein carbon dioxide is used as said refrigerant, wherein said turning scroll part comprises a communication passage provided in the turning scroll part, and a throttle hole through which lubricant flows to a back pressure chamber adjusted to said turning scroll part, said back pressure chamber at least intermittently communicating with said sucked refrigerant, wherein a diameter of said throttle hole is adjusted such that an amount of the lubricant supplied into said compression chamber is set to a ratio of 2% by weight or more and less than 20% by weight of an amount of the lubricant to the refrigerant trapped in said compression chamber when a suction stroke of said refrigerant is completed.

2. The scroll compressor according to claim 1, wherein a volume of the intake chamber of said fixed scroll part is 20% or more of a displacement volume of said compression chamber.

3. The scroll compressor according to claim 1, wherein said throttle hole is assembled into said communication passage.

4. The scroll compressor according to claim 1, wherein the lubricant flows intermittently through said throttle hole by driving said turning scroll part.

5. The scroll compressor according to anyone of claims 1, 2, and 4, wherein oil having polyalkylene glycol as main ingredient is used as the lubricant.

6. The scroll compressor according to any one of claims 1, 2, and 4, wherein oil having polyol ester as main ingredient is used as the lubricant.

7. The scroll compressor according to claim 1, wherein the throttle hole through which lubricant flows intermittently by driving said turning scroll part is adjusted such that a supply amount of lubricant supplied to the compression chamber is given by $$Q=C\cdot\Delta P\cdot(f/v)\cdot\log\{\cosh\{v\cdot(32/d^2)\cdot(\mathrm{To}/360)\cdot(1/f)\}\}$$

where Q is the supply amount, C is a constant, ΔP is a pressure difference, f is a frequency, v is kinematic viscosity, d is a diameter of the throttle hole, and To is a time per one rotation of the turning scroll part.

* * * * *